United States Patent [19]

Corna et al.

[11] Patent Number: 4,501,100

[45] Date of Patent: Feb. 26, 1985

[54] METHOD AND APPARATUS FOR MAKING SWIMMING POOLS

[75] Inventors: John F. Corna, Columbus; Marcel H. Blais, Westerville, both of Ohio

[73] Assignee: Statewide Pools, Inc., Columbus, Ohio

[21] Appl. No.: 398,949

[22] Filed: Jul. 16, 1982

[51] Int. Cl.[3] ..... E04H 3/18

[52] U.S. Cl. ..... 52/169.7; 52/541; 52/741; 4/506

[58] Field of Search ..... 52/169.7, 741, 541, 52/592; 4/506

[56] References Cited

U.S. PATENT DOCUMENTS

| | | | |
|---|---|---|---|
| 108,068 | 10/1870 | Utley | 52/541 X |
| 1,729,946 | 10/1929 | Kuehn | 52/541 X |
| 2,239,011 | 4/1941 | Meslin | 52/592 X |
| 3,673,751 | 7/1972 | Boassy et al. | 52/169.7 |
| 3,801,993 | 4/1974 | Stalder | 52/169.7 |

FOREIGN PATENT DOCUMENTS

| | | | |
|---|---|---|---|
| 98025 | 8/1979 | Japan | 52/169.7 |
| 1571794 | 7/1980 | United Kingdom | 52/169.7 |
| 1582850 | 1/1981 | United Kingdom | 52/169.7 |

*Primary Examiner*—J. Karl Bell

*Attorney, Agent, or Firm*—Pearne, Gordon, Sessions, McCoy, Granger & Tilberry

[57] ABSTRACT

A method and apparatus for making swimming pools wherein all the pool walls are formed from sheet metal panels joined together at welded junctions. The method and apparatus is characterized by constructing the bottom wall of the pool from a plurality of bottom wall panels provided with edge flange configurations that mate with edge flanges on adjacent panels and thereby facilitate alignment of the panels during assembly. The mating edge flanges of the panels are further adapted to locate the top surfaces of the panels in co-planar relationship to provide a flush pool bottom. In addition, the edge flanges of the panels are adapted to form weld receiving grooves that result in non protruding welded junctions between the panels. The present method is further characterized by constructing the side wall panels with side wall bottom flanges that are welded to the periphery of the sheet metal bottom wall which bottom flanges are laterally yieldable under thermally and hydrostatically imposed stresses on the bottom wall.

21 Claims, 9 Drawing Figures

METHOD AND APPARATUS FOR MAKING SWIMMING POOLS

BACKGROUND OF THE INVENTION

This invention relates to swimming pools and more particularly to a novel method of making swimming pools wherein the pool walls are formed from sheet metal panels of unique configuration.

PROBLEMS IN THE ART

It is the present practice in the art to fabricate swimming pool side walls, gutters, and water delivery conducts as unitary constructions which are assembled from stainless steel sheet metal components. The bottom wall of the pools are generally formed of poured concrete with the lower edges of the sheet metal side wall panels being imbedded in the concrete. In some prior instances, pools have been constructed with bottom walls formed of sheet metal panels, welded together in edge to edge relationship. In such prior constructions the bottom wall panels have consisted of flat sheet metal sections, having co-planer edges, that are butt joined to edges of adjacent panels. Such butt joints have required the use of separate underlying back-up strips at each panel junction. Problems are presented in the use of such butt joints with back-up strips, in that the strips must be tack welded to the under side of one of the confronting panels at each panel junction, in order to maintain the back-up strips in position, while the panels are being assembled on the bottom supporting surface. Hence, costly preliminary tack welding operations are required.

Another problem is encountered with butt joints and back-up strips, in that it is difficult to align the confronting panel edges, so as to establish a controlled gap of uniform width which is required for receiving the continuous weld that joins and seals the panel edges. Still another problem is encountered when using butt joints with back-up strips in that the panels tend to warp away from the back-up strips during the formation of the above mentioned continuous weld. In other prior installations metal bottom walls have been installed in pools using metal panels that are joined together by lap joining the panel edges at welded junctions. Such prior constructions have presented problems in that the lap joints at the panel edges necessarily form irregular steps at the junctions that are hazardous to bathers, preclude automatic vacuum cleaning, and form pockets that collect algae.

Another problem encountered in the prior use of sheet metal panels for pool bottoms has resulted from distortion and damage to the pool walls caused by thermally and hydrostatically imposed forces that expand and contract the metal bottom walls of the pools.

Still another problem has been encountered in prior applications of metal panels for pool bottoms in that such bottom panels have been rigidly fastened at spaced anchor points to underlying metal frames and footers which have been anchored in the bed that underlies the pool bottom. In such installations, the application of hydrostatic pressures on the bottom panels from water, in the underlying fill have caused the rigidly attached footers to rise in the bed such that when the hydrostatic pressures subside, the panels distort downwardly between the raised anchor points, causing unsightly distortions in the pool bottom and, under severe conditions, actual destruction of the bottom panels of the pool.

SUMMARY OF THE INVENTION

In general, the present invention comprises a novel method of making swimming pools wherein the bottom walls of the pool are constructed from a plurality of identical sheet metal panels of unique configuration adapted to be welded together in edge to edge relationship.

As one aspect of the present invention, the novel bottom wall panels are adapted for self aligning disposition on the bed that underlies the pool bottom, and in addition are adapted to establish weld receiving grooves of controlled dimensions, so as to provide a smooth flush bottom, as well as high structural strength at the welded panel junctions. These advantages result from novel flange configurations provided on the panel edges, as set forth in detail later herein.

As another aspect of the present invention the pool is provided with a novel laterally yieldable junction construction at the junctions between the bottom wall panels and the side wall panels. Such yieldability is effected by providing unsupported lower flanges on the side wall panels which lower flanges extend freely from the side wall supporting structure, so as to be laterally yieldable, responsive to expansion and contraction of the above mentioned assembly of bottom wall panels.

As another aspect of the present invention, the assembly of sheet metal panels that form the bottom wall for the pool are uniquely arranged on the underlying bed in unattached relationship therewith, such that the entire sheet metal floor assembly, including its junctions with the side walls, is "free-floating" with respect to the underlying bed.

As a result, the entire pool bottom assembly is free to yield vertically when changes in hydrostatic pressures and thermal stresses are imposed.

As another aspect of the present invention, the pool is provided with a metal bottom wall that comprises an assembly of panels of unique configuration, which configuration permits the use of relatively thin light gauge sheet metal in constructing a bottom wall of high structural integrity. Hence, economy in metal cost is achieved, thereby making stainless steel bottom wall competitive with poured concrete and other bottom wall constructions.

It is therefore an object of the present invention to provide a swimming pool construction and method of making same wherein the bottom wall of the pool can be fabricated from a plurality of sheet metal bottom wall panels that are self aligning to facilitate assembly of the panels on the underlying bed.

It is another object of the present invention to provide a swimming pool construction and method of making same which can be fabricated from a plurality of sheet metal panels of novel configuration, which panels are adapted to provide inter panel junctions that automatically form weld receiving grooves of controlled dimension, when the panels are layed out on the underlying bed.

It is another object of the present invention to provide a method and construction of the type described wherein the bottom wall of the pool includes bottom wall panels uniquely adapted to be joined together at non-protruding welded junctions, so as to provide a smooth, flush bottom surface for the pool.

It is another object of the present invention to provide a method and construction of the type described wherein the bottom pool wall of the pool includes bottom wall panels uniquely adapted to be joined together at edge junctions provided with offset stiffner flanges at welded junctions, so as to achieve high structural integrety in the bottom wall assembly, as well as eliminate excessive warpage during welding of the junctions.

It is another object of the present invention to provide a method and construction of the type described wherein the bottom wall of the pool includes bottom wall panels uniquely adapted to be joined together without the use of back-up strips at the panel junctions, thereby eliminating said back-up strips, as well as the tack welding operations required thereby.

It is another object of the present invention to provide a swimming pool construction and method of making same whereby the pool includes a sheet metal bottom and ajoining side walls that are uniquely constructed and assembled, so as to be free to expand and contract under thermally and hydrostatically imposed stresses.

It is another object of the present invention to provide a swimming pool construction and method of making same wherein the pool includes a sheet metal bottom adapted for unrestraint vertical movement relative to the underlying bed, thereby preventing distortion of the bottom structure by thermal expansion of the metal bottom and hydrostatic pressures from the surrounding fill.

Further objects and advantages of the present invention will be apparent from the following description, reference being had to the accompanying drawings wherein a preferred form of embodiment of the invention is clearly shown.

DESCRIPTION OF THE PREFERRED EMBODIMENT

Figure 1:
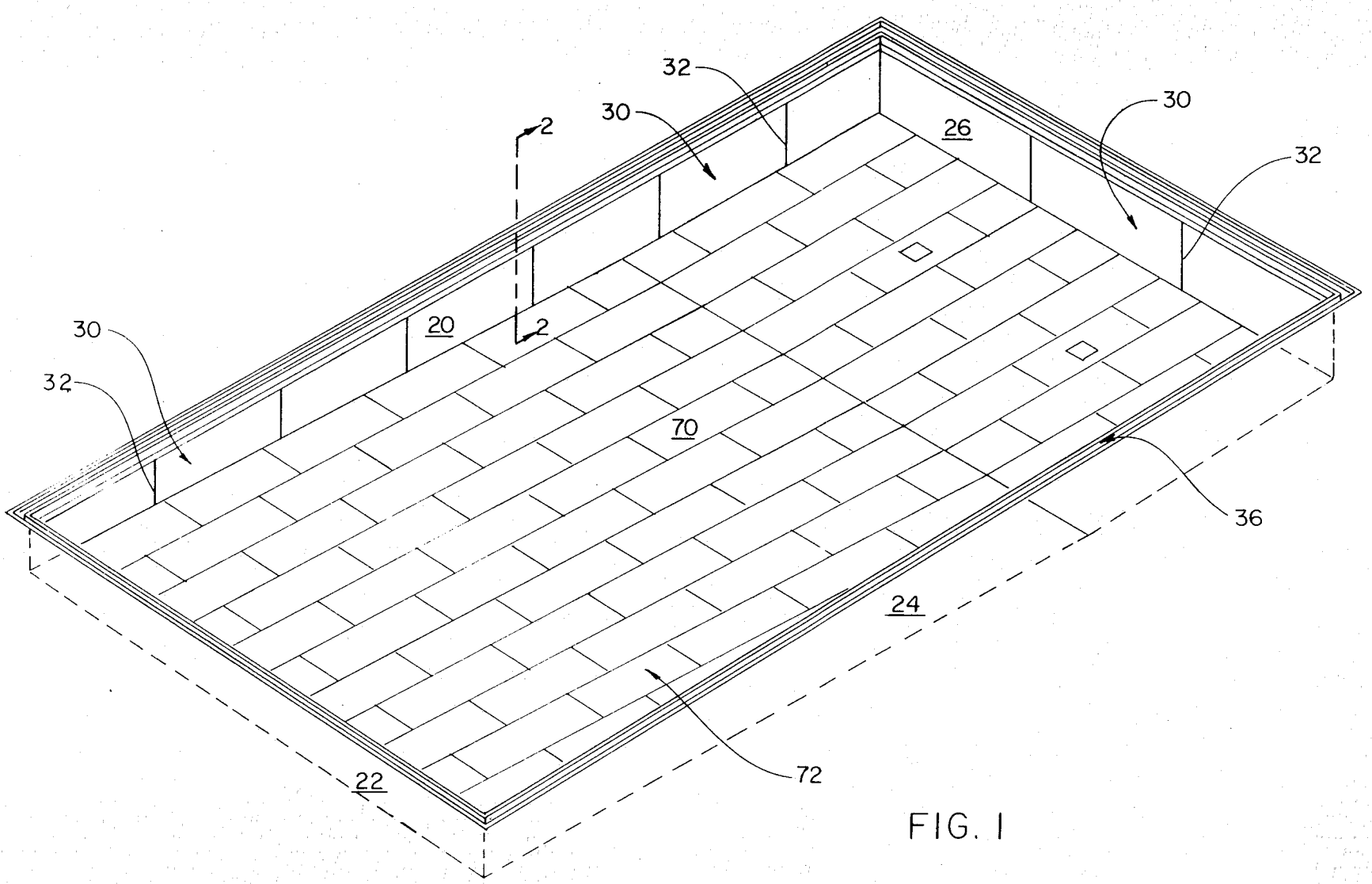
FIG. 1 is a perspective view of a typical swimming pool that includes sheet metal walls constructed in accordance with the present invention.

Referring in detail to the drawings, FIG. 1 illustrates a typical swimming pool constructed in accordance with the present invention. The pool comprises side walls indicated generally at 20, 22, 24 and 26 which are formed from a plurality of sheet metal side wall panels 30 joined together in edge to edge relationship at welded junctions 32.

Figure 2:
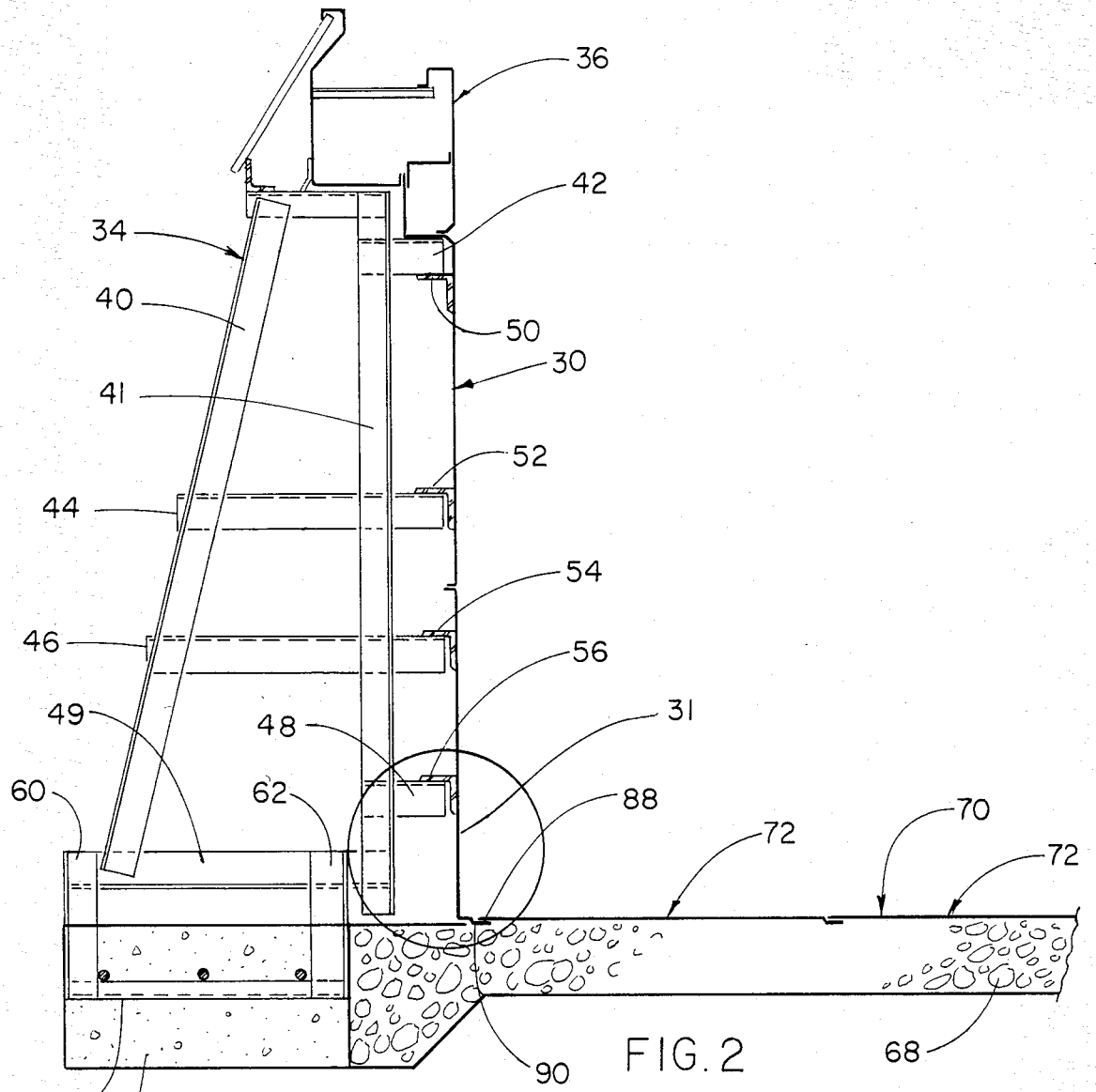
FIG. 2 is a partial side sectional view showing the walls and wall supporting means for the pool of FIG. 1, the section being taken along the line 2—2 of FIG. 1.

Referring to FIG. 2 the side wall panels are mounted on a plurality of spaced side wall supporting frame means or buttresses one of which is indicated generally at 34. The upper portion of the side wall panel construction illustrated in FIG. 2 is a typical design and comprises a portion of the gutter and recirculating conduit assembly for the pool, with such assembly being indicated generally at 36 in FIGS. 1 and 2.

The details of the structure and erection of gutter and conduit assembly 36 are described in detail in our copending application Ser. No. 06,249,748, filed Apr. 1, 1981 now U.S. Pat. No. 4,400,834.

Figure 4:
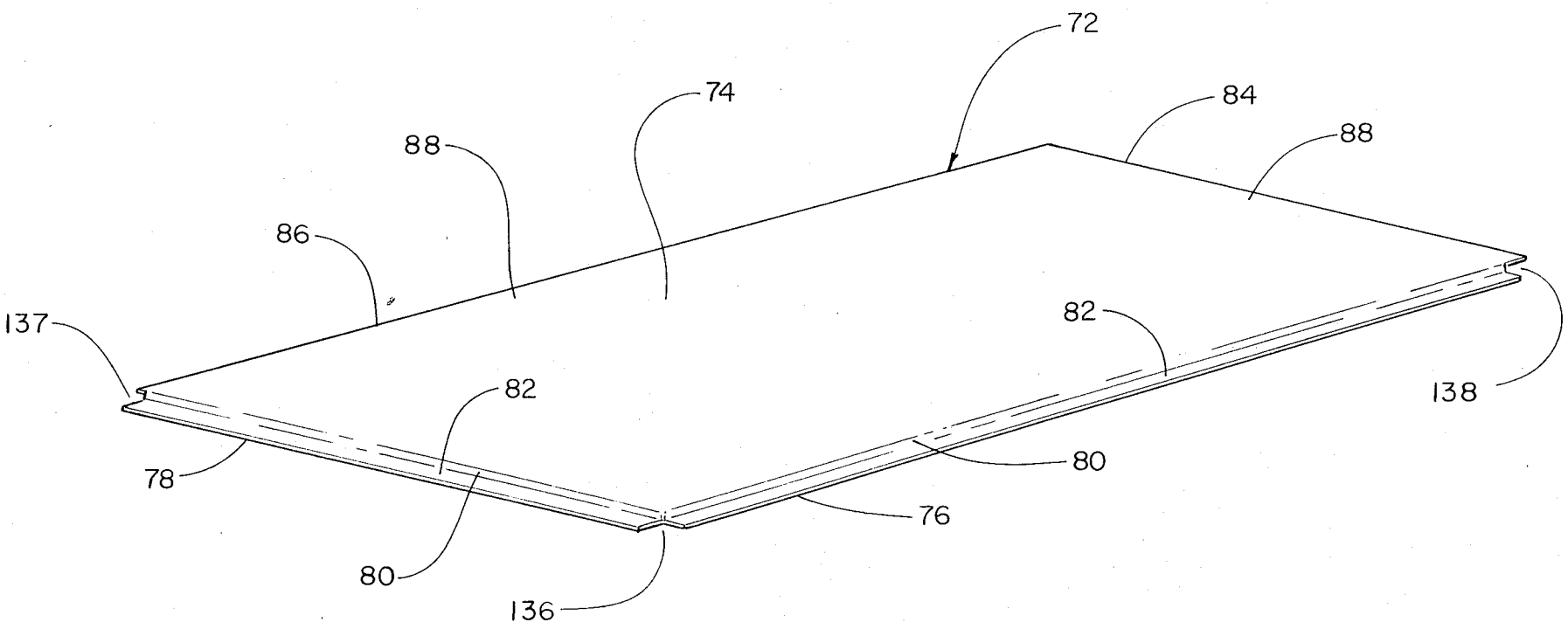
FIG. 4 is a perspective view of a bottom wall panel constructed in accordance with the present invention.
Figure 7:
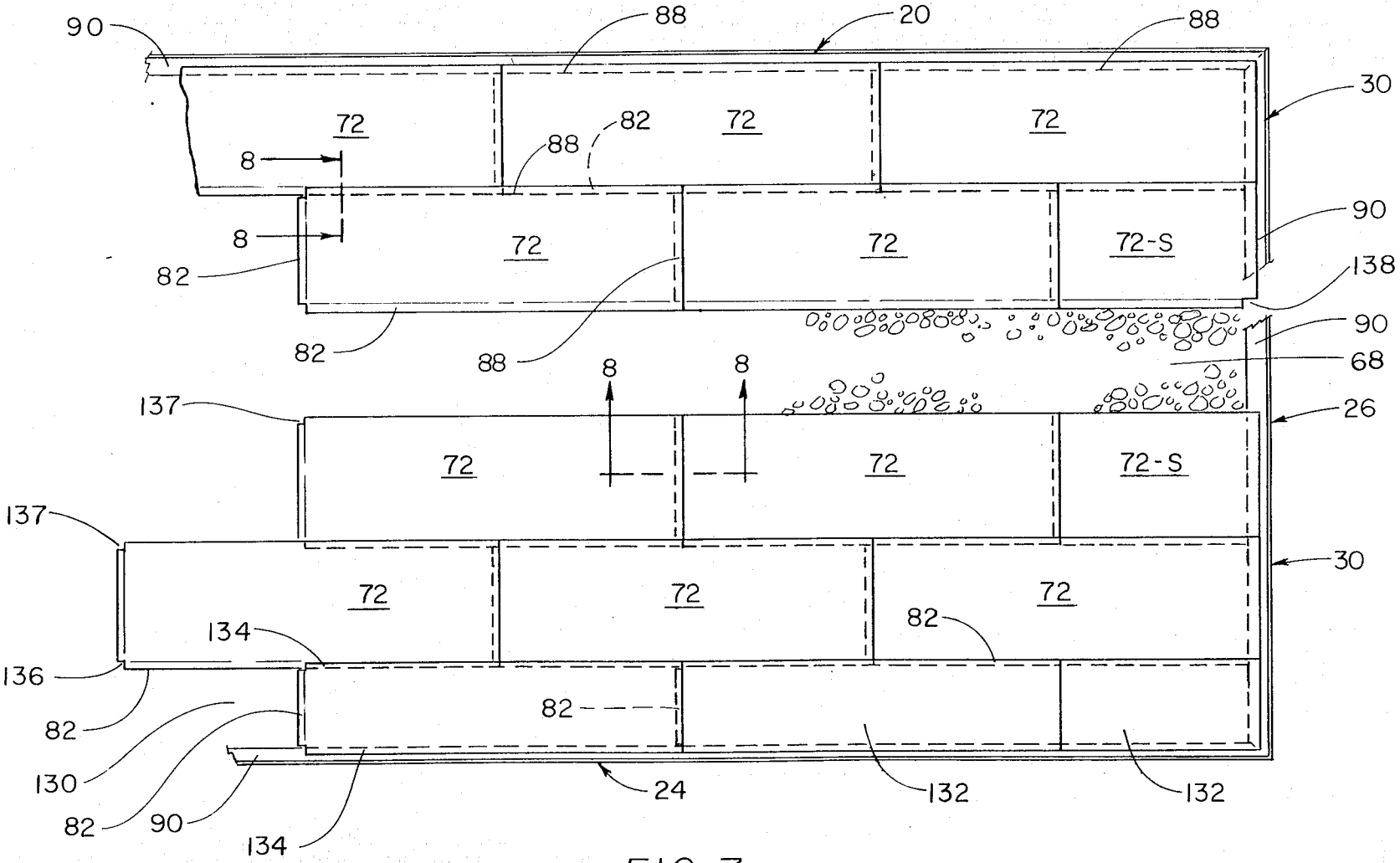
FIG. 7 is an enlarged partial top view of the bottom wall of the pool of FIG. 1.
Figure 8:
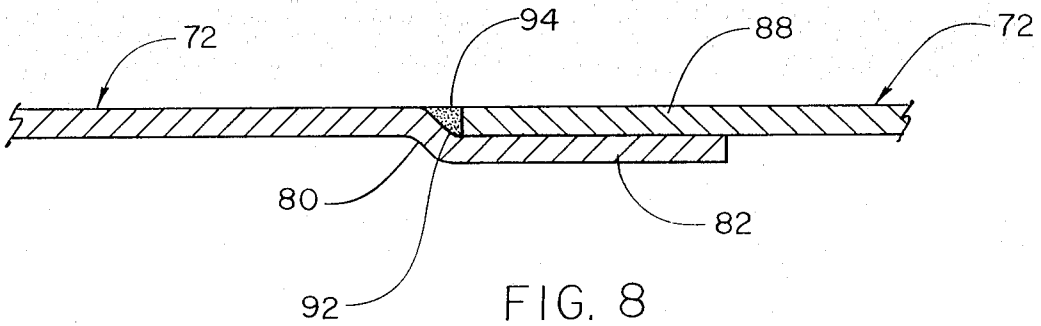
FIG. 8 is an enlarged fragmentary view in section showing the welded joint construction between adjacent bottom wall panels.

Referring again to FIG. 2, frame means 34 comprises vertical frame members 40 and 41 and horizontal frame members 42-49 which serve to mount a plurality of longitudenal frame members 50-56, the latter being extended around the periphery of the pool wall in end to end relationship, sidewall panels are mounted on the supporting frame means by welding their outer surfaces to longitudinal frame members 50-56. Each of the side wall supporting frame means 34, further includes a base portion comprising members 60, 62 and 64 which are anchored in a poured concrete footing 66 that extends around the perimeter of a bed 68 formed by a layer of gravel or the like. In typical installations of large commercial pools, such as are used for competetive swimming and recreation, the bottom wall panels 72 of the present invention are preferably formed of stainless steel sheet metal. Such sheet material can, in view of the high strength to weight ratio of the novel panel configuration and assembly, be formed from relatively thin gauge material, such as twelve gauge, as contrasted with relatively thick plate material. As best seen in FIGS. 4 and 7, each bottom wall panel 72 includes a bottom panel central portion 74 that defines the surface of the bottom of the pool. Each panel 74 further includes two bottom panel edges 76 and 78, each of which includes an offset 80 and an underlap flange 82, and two bottom panel edges 84 and 86, each of which includes a bottom panel overlap flange 88. It should be pointed out that the offsets 80 formed on two edges of each panel 82 occur at each welded junction in the floor assembly. Hence, such offsets provide integral stiffner portions at all of the welded seams.

Figure 5:
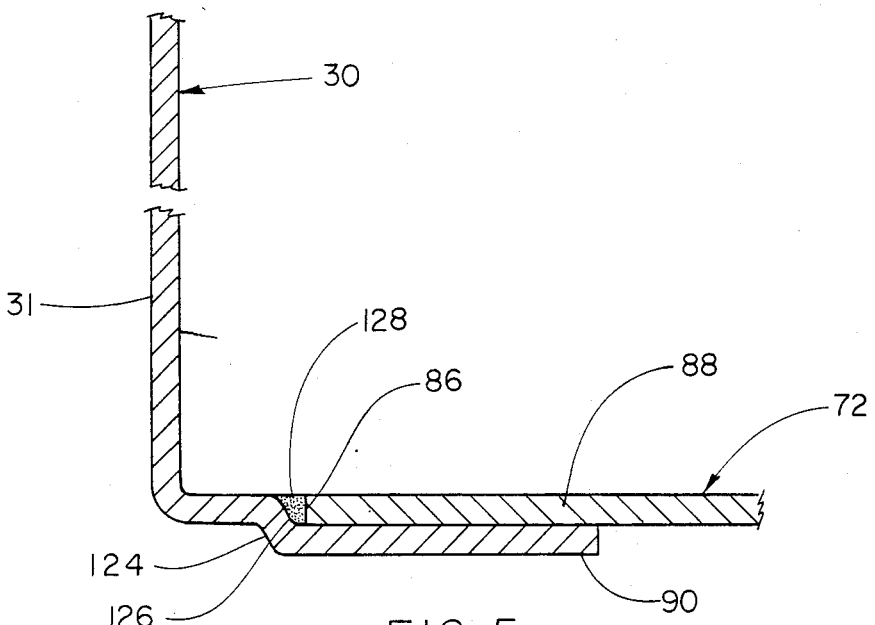
FIG. 5 is a sectional view showing a junction used in the wall construction of FIG. 2.
Figure 9:
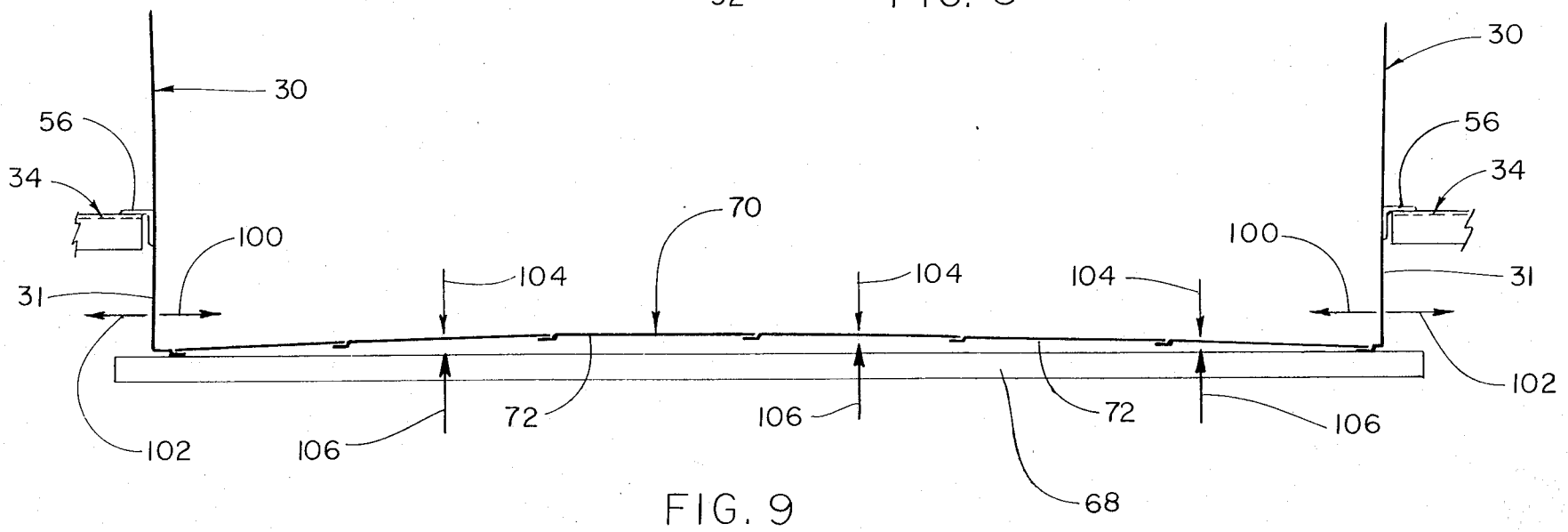
FIG. 9 is a diagrammatic view of the pool wall construction shown in the preceding Figures.

With reference to FIGS. 4, 7, and 9, the bottom wall panels are assembled on the gravel bed 68, as seen in FIG. 7, and such that the above mentioned overlap flanges 88 overly the underlap flanges 82 and with edges 84 and 86 confronting respective offsets 80 on adjacent panels, so as to form weld receiving grooves 92 for receiving continous welds 94 that join and seal the mating edges of panels 72. The periphery of the assembly of bottom wall panels is joined to the side wall panels 30, by welding the outer edges of the bottom wall panels to a side wall flange 90 that is formed by bending the lower edges of side wall panels 30 inwardly as seen in FIGS. 2, 5, and 7. It should be pointed out that side wall panels 30 each include a lower panel portion 31 that extends freely downwardly from its lowest mounting location at horizontal members 56 of supporting frame means 34. Hence, the junctions of the side wall and bottom wall panels are free to yield laterally with respect to the rigid supporting frame means 34 in the manner shown by the arrows 100 and 102 in the diagrammatic view of FIG. 9. Such yieldability of the side to bottom wall junctions permits thermal expansion and contraction of the metal bottom wall 70 without imposing damaging stresses on the structure and also serves to eliminate distortion and excessive stresses on the bottom wall panel assembly.

Referring again to FIG. 9, it should also be pointed out, that bottom wall 70 is freely supported, relative to the underlying gravel bed 68. That is to say, no foundation anchor points are used between bed 68 and bottom wall 70, whereby the bottom wall assembly of panels is free to flex vertically as a unit under variations in hydrostatic forces imposed by poolwater and water in the surrounding fill. Such hydrostatic forces are diagrammatically represented by arrows 104 and 106 in FIG. 9.

Figure 3:
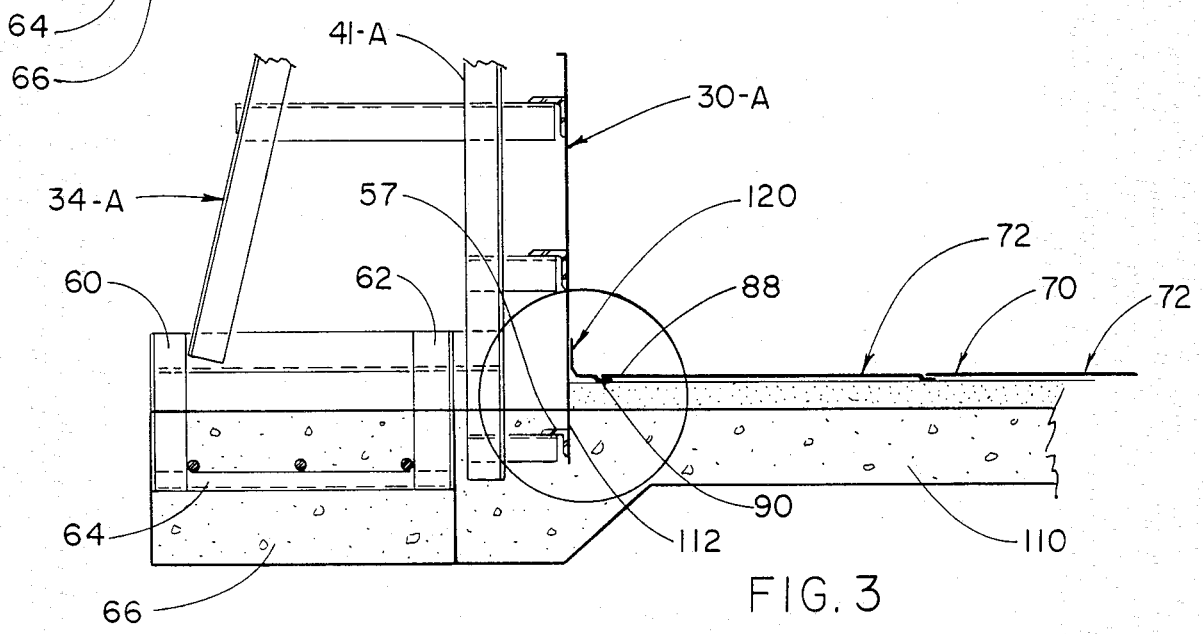
FIG. 3 is a second partial side elevational view corresponding to the view of FIG. 2 that illustrates a modified pool wall.
Figure 6:
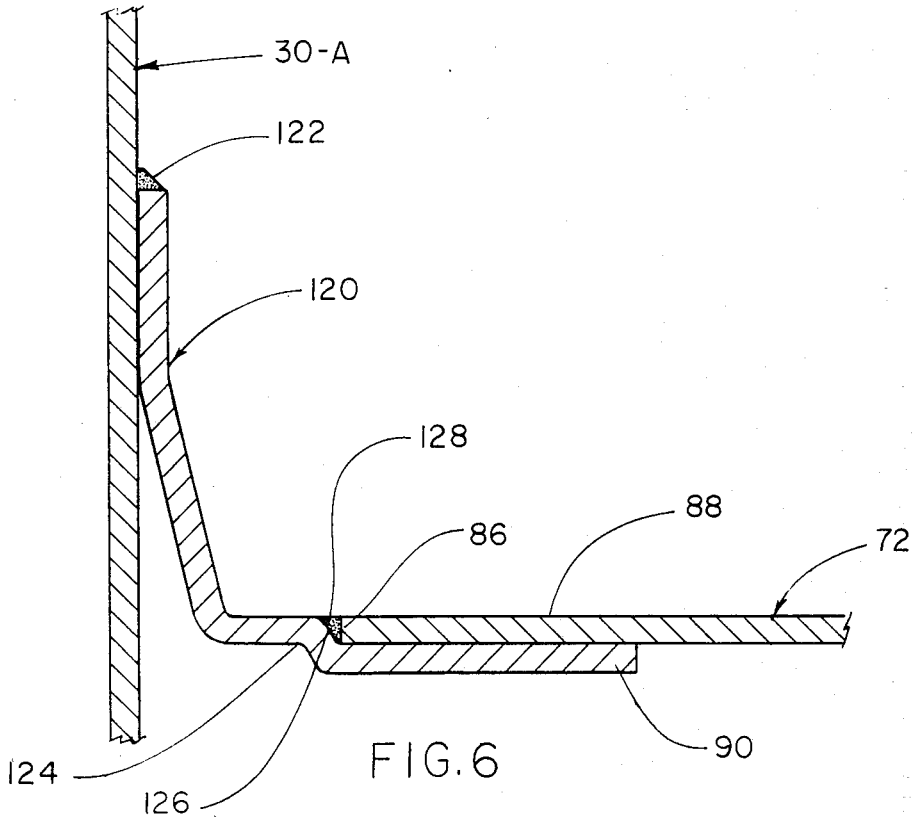
FIG. 6 is another partial sectional view showing a modified junction used in the wall construction of FIG. 3.

Reference is next made to FIGS. 3 and 6 which illustrate a modification of the present invention which is used for installation of new sheet metal bottom wall 70, previously described, in an existing pool of the type that includes sheet metal side wall panels and a concrete bottom wall 110. In such installations the side wall panels 30-A, FIG. 3, include lower panel edges 112, embedded in the old original poured concrete floor 110 and rigidly welded to a lower framme member 57. In accordance with the present invention, the previously described feature of a yieldable side to bottom wall junction is provided by a separate sheet metal side wall bottom member, indicated generally at 120 in FIGS. 3 and 6. Such side wall bottom member 120 extends peripherally around the pool to a flange similar to the previously described side wall flange 90. Bottom member 120 underlays and is welded at 122 to the inner face lower panel portion 31 and at 128 to the edge of the bottom wall panel assembly 72. It should be mentioned that of the embodiments of FIGS. 5 and 6 include an offset 124 that confronts edge 86 of the overlays flange 88 and forms a groove 126 for receiving the continuous weld 128 that joins the outer edges of the bottom wall assembly to underlying flanges 90. It should also be emphasized that offsets 124 provide means for self alignment of bottom wall panels 72 when they are being placed into position on flanges 90 and the bed.

Referring to FIG. 7, the bottom wall panels 72 are preferably installed in place by starting at a corner, such as the corner shown at the junction of side walls 20 and 30 in FIG. 7. The panels 72 are successively positioned in a strip along side wall 20 with overlying flanges 88 positioned on side wall flange 90. Since the panels 72 are of standard size and configuration, the last panel in the strip must be cut to the proper length dimension to fit the end gap. This will also remove the standard underlap flange 82 and provide an overlap similar to opposite flange 88 to mate with side wall flange 90.

A second strip of panels 72 is next positioned adjacent the first strip with the first panel 72-S being cropped to provide the staggered panel junctions seen in FIG. 7. The strips of panels are successively positioned in the manner described until the other side wall 24, FIG. 7, is approached leaving a gap 130 that is narrower than the width of standard panels 72. Such narrow gap is closed by cutting a standard panel 72 longitudinally to the proper width thereby eliminating the underlap flange 82 and providing an overlap similar to opposite flange 88 required for side wall flange 90. Panels 72 are formed with cut-outs 136, 137 and 138 at three of the corners shown in FIG. 4 to relieve forming stresses and to prevent corner interference between the overlap flanges and underlap flanges during assembly of the panels.

Various additional modifications and variations of these basic structures will occur to those skilled in the art. All such variations which rely on the teachings through which this invention has advanced the art are considered within the scope of this invention.

What is claimed is:

1. The method of making a swimming pool from a plurality of identically formed and dimensioned rectangular sheet metal panels comprising the steps of forming a bottom wall supporting bed surrounded by a footing defining the periphery of the pool; erecting a plurality of spaced-apart side wall supporting frame means on the footing in spaced relationship around the periphery of the bed; mounting a plurality of sheet metal side wall panels on said frame means with vertical edges of said side wall panels joined together in edge to edge relationship and bottom portions forming inwardly extending horizontal side wall flanges; forming a plurality of said identically formed and dimensioned rectangular sheet metal bottom panels, each of which includes a central bottom panel portion, two normally intersecting bottom panel edges each of which includes an offset and a bottom panel underlap flange and two normally intersecting bottom panel edges each of which includes a bottom panel overlap flange; positioning said bottom panels on said bed in aligned edge to edge relationship with said overlap flanges overlaying the underlap flanges of the next adjacent panels and with the edges of the overlap flanges spaced from confronting offsets on next adjacent panels to form weld receiving grooves; forming welds in said weld receiving grooves to join and seal said bottom panels; and forming welded junctions between outer edges of the outer panels of said plurality of bottom wall panels of said plurality of bottom wall panels and said inwardly extending horizontal side wall flanges.

2. The method of making a swimming pool from a plurality of identically formed and dimensioned rectangular sheet metal panels comprising the steps of forming a bottom wall supporting bed surrounded by a footing defining the periphery of the pool; erecting a plurality of laterally spaced-apart side wall supporting frame means on the footing in spaced relationship around the periphery of the bed; mounting a plurality of sheet metal side wall panels on said frame means with vertical edges of said side wall panels joined together in edge to edge relationship, each side wall panel including an upper side wall panel portion rigidly attached to the supporting frame means and a lower side wall panel portion extending downwardly partially unsupported by the frame means to provide for lateral shifting movement relative to the frame means, and a side wall panel horizontally extending bottom flange; forming a bottom wall from a plurality of said sheet metal panels in overlaying relationship with said bed, said bottom wall panels being joined in edge to edge relationship at welded junctions; and forming welded junctions between outer panels of said plurality of bottom wall panels and said side wall bottom flanges.

3. The method of making a swimming pool from a plurality of identically formed and dimensioned rectangular sheet metal panels comprising the steps of forming a bottom wall supporting bed surrounded by a footing defining the periphery of the pool; erecting a plurality of laterally spaced-apart side wall supporting frame means on the footing in spaced relationship around the periphery of the bed; mounting a plurality of sheet metal side wall panels on said frame means with vertical edges of said side wall panels joined together in edge to edge relationship, each side wall paneling including an upper side wall panel portion rigidly attached to the supporting frame means and a lower side wall panel portion extending downwardly partially unsupported by the frame means to provide for lateral shifting movement relative to the frame means and a side wall panel horizontally extending bottom flange; forming a plurality of said sheet metal bottom panels each of which includes a central bottom panel portion, two normally intersecting bottom panel edges each of which includes an offset and a bottom panel underlap flange, and two normally intersecting bottom panel edges each of which includes a bottom panel overlap flange; positioning said bottom panels on said bed in aligned edge to edge relationship with said overlap flanges overlaying the underlap flanges of the next adjacent panels and with the edges of the overlap flanges spaced from confronting offsets on next adjacent panels to form weld receiving grooves; forming welds in said weld receiving grooves to join and seal said bottom panels; and forming welded junctions between outer edges of the outer panels of said plurality of bottom wall panels and said side wall bottom flanges.

4. A swimming pool comprising, in combination, a bottom supporting bed surrounded by a footing defining the periphery of said pool; a plurality of laterally spaced apart side wall supporting frame means mounted on the footing in spaced relationship around the periphery of the bed; spaced side walls comprising a plurality of sheet metal side wall panels mounted on the frame means, each side wall panel including vertical edges joined to the vertical edge of a next adjacent side wall panel, and a side wall panel bottom including a side wall flange; a bottom wall overlying the bed and comprising a plurality of rectangular sheet metal bottom wall panels joined in edge to edge relationship at welded junctions, each bottom wall panel including a central bottom panel portion, two bottom panel edges each of which includes an offset and a bottom panel underlap flange, and two bottom panel edges each of which includes a bottom panel overlap flange, each of said welded junctions comprising an underlap flange, an overlap flange from a next adjacent bottom wall panel overlying said underlap flange and including an overlap flange edge spaced from the offset on the underlap flange to form a weld receiving groove; welds in said weld receiving grooves to form said welded junctions; and welded junctions between outer edges of the outer panels of the plurality of bottom wall panels and said side wall flanges.

5. A swimming pool comprising, in combination, a bottom supporting bed surrounded by a footing defining the periphery of said pool; a plurality of laterally spaced-apart side wall supporting frame means mounted on the footing in spaced relationship around the periphery of the bed; side walls comprising a plurality of sheet metal side wall panels mounted on the frame means, each side wall panel including an upper side wall panel portion rigidly attached to the supporting frame means and a lower side wall panel portion extended freely downwardly from the frame means adapted for shifting movement relative to the frame means, and a side wall panel bottom including a horizontally extending side wall flange; a bottom wall overlaying the bed and comprising a plurality of rectangular sheet metal bottom wall panels joined in edge to edge relationship at welded junctions; and welded junctions between the outer edges of the outer panels of the plurality of bottom wall panels and said side wall flanges.

6. A swimming pool comprising, in combination, a bottom supporting bed surrounded by a footing defining the periphery of said pool; a plurality of laterally spaced-apart side wall supporting frame means mounted on the footing in spaced relationship around the periphery of the bed; side walls comprising a plurality of sheet metal side wall panels mounted on the frame means, each side wall panel including an upper side wall panel portion rigidly attached to the supporting frame means and a lower side wall panel portion extending freely downwardly from the frame means for lateral shifting movement relative to the frame means, and a side wall panel bottom including a horizontally extending side wall flange; a bottom wall overlaying the bed and comprising a plurality of rectangular sheet metal bottom wall panels joined in edge to edge relationship at welded junctions, each bottom wall panel including a central bottom panel portion, two bottom panel edges, each of which includes an offset and a bottom panel underlap flange, and two bottom panel edges each of which includes a bottom panel overlap flange, each of said welded junctions comprising an underlap flange, an overlap flange from a next adjacent bottom wall panel overlaying said underlap flange and including an overlap flange edge spaced from the offset on the underlap flange to form a weld receiving groove; welds in said weld receiving grooves to form said welded junctions; and welded junctions between outer edges of the outer panels of the plurality of bottom wall panels and said horizontally extending side wall flanges.

7. The method of making swimming pools comprising the steps of forming a bottom wall supporting bed surrounded by a footing defining the periphery of the pool; erecting pool side walls on said footing, said side walls including metal horizontally extending side wall flanges adjacent said bed; forming a plurality of rectangular sheet metal bottom panels, each of which includes a central bottom panel portion having two bottom panel edges with offsets and bottom panel underlap flanges and two bottom panel edges with overlap flanges; positioning said bottom panels on said bed in aligned edge to edge relationship with said overlap flanges overlaying the underlap flanges of the next adjacent panels and with the edges of the overlap flanges being spaced from offsets on next adjacent panels to form weld receiving grooves; forming welds in said weld receiving grooves to join and to seal said bottom panels; and forming welded junctions between outer edges of the outer panels of said plurality of bottom wall panels and said horizontally extending side wall flanges.

8. The method of making swimming pools comprising the steps of forming a bottom wall supporting bed surrounded by a footing defining the periphery of the pool; erecting pool side walls on said footing, said side walls including flexible metal side wall flanges that extend freely and horizontally at said bed to form laterally yieldable side to bottom wall junctions; forming a bottom wall from a plurality of rectangular sheet metal panels in overlaying relationship with said bed, said bottom wall panels being joined in edge to edge relationship at welded junctions; and forming welded junctions between outer panels of said plurality of bottom wall panels and said horizontally extending side wall flanges.

9. The method of making swimming pools comprising the steps of forming a bottom wall supporting bed surrounded by a footing defining the periphery of the pool; erecting pool side walls on said footing, said side walls including flexible horizontal side wall flanges that extend freely at said bed to form yieldable side to bottom wall junctions forming a plurality of rectangular sheet metal bottom panels each of which includes a central bottom panel portion, two bottom panel edges each of which includes an offset and a bottom panel underlap flange, and two bottom panel edges each of which includes a bottom panel overlap flange; positioning said bottom panels on said bed in aligned edge to edge relationship with said overlap flanges overlaying the underlap flanges of the next adjacent panels and with the edges of the overlap flanges spaced from offsets on next adjacent panels to form weld receiving grooves; forming welds in said weld receiving grooves to join and seal said bottom panels; and forming welded junctions between outer edges of the outer panels of said plurality of bottom wall panels and said side wall flanges.

10. A swimming pool comprising, in combination, a bottom supporting bed surrounded by a footing defining the periphery of said pool; side walls on said footing and including horizontal metal side wall flanges adjacent said bed; a bottom wall overlying the bed and comprising a plurality of rectangular sheet metal bottom wall panels joined in edge to edge relationship at welded junctions each bottom wall panel including a central bottom panel portion, two bottom panel edges each of which includes an offset and a bottom panel underlap flange, and two bottom panel edges each of which includes a bottom panel overlap flange, each of said welded junctions comprising an underlap flange, an overlap flange from a next adjacent bottom wall panel overlying said underlap flange and including an overlap flange edge spaced from the offset on the underlap flange to form a weld receiving groove; welds in said weld receiving grooves to form said welded junctions; and welded junctions between outer edges of the outer panels of the plurality of bottom wall panels and said horizontal side wall flanges.

11. A swimming pool comprising, in combination, a bottom supporting bed surrounded by a footing defining the periphery of said pool; side walls on said footing and including horizontal flexible metal side wall flanges that extend freely at said bottom supporting bed and form yieldable side to bottom wall junctions; a bottom wall overlying the bed and comprising a plurality of rectangular sheet metal bottom wall panels joined in edge to edge relationship at welded junctions; and welded junctions between the outer edges of the outer panels of the plurality of bottom wall panels and said horizontal side wall flanges.

12. A swimming pool comprising, in combination, a bottom supporting bed surrounded by a footing defining the periphery of said pool; side walls on said footing and including horizontal flexible metal side wall flanges that extend freely at said bottom supporting bed and form laterally yieldable side to bottom wall junctions; a bottom wall overlying the bed and comprising a plurality of rectangular sheet metal bottom wall panels joined in edge to edge relationship at welded junctions, each bottom wall panel including a central bottom panel portion, two bottom panel edges each of which includes a bottom panel overlap flange, each of said welded junctions comprising an underlap flange, an overlap flange from a next ajacent bottom wall panel overlying said underlap flange and including an overlap flange edge spaced from the offset on the underlap flange to form a weld receiving groove; welds in said weld receiving grooves to form said welded junctions; and welded junctions between outer edges of the outer panels of the plurality of bottom wall panels and said horizontal side wall flanges.

13. For use in fabricating a swimming pool, a universal bottom wall panel module adapted to interfit with a plurality of like panels comprising: a rectangular sheet having a first pair of intersecting edges formed to provide offsets and underlap flanges, and having a second pair of intersecting edges having overlap flanges, whereby said panel modules are adapted to be positioned in tandem to form rows and with said rows being in parallel relationship with each other, wherein the overlap flanges of one panel module are adapted to overlap the underlap flanges of an adjacent panel module to form a mosaic bottom for a swimming pool.

14. The bottom wall panel module of claim 13, wherein said offsets are dimensioned to locate the upper surfaces of said overlap flanges in the same horizontal plane as the upper surfaces of adjacent panel modules.

15. The bottom wall panel module of claim 14, wherein said offsets are inclined to the vertical to provide V-shaped grooves between said offsets and the edges of the overlap flanges of adjacent panel modules for applying welding material.

16. For use in fabricating a swimming pool, in combination, a universal vertical side wall panel module and a universal bottom wall panel module adapted to interfit to form the side and bottom walls of a swimming pool, comprising: said vertical side wall panel module having its bottom edge formed to provide a horizontally extending portion, said portion being further formed to provide an offset and an underlap flange; said universal bottom wall panel module being formed from a rectangular sheet having a first pair of intersecting edges formed to provide offsets and underlap flanges, and having a second pair of intersecting edges having overlap flanges, whereby said bottom wall panel modules are adapted to be positioned in tandem to form rows and with said rows being in parallel and staggered relationship with each other, wherein the overlap flanges of one panel module are adapted to overlap the underlap flanges of an adjacent panel module to form a coplanar mosaic bottom for a swimming pool, and wherein the overlap flanges of the first row of panel modules are adjacent to and adapted to overlap the underlap flanges of a plurality of coplanar vertical side wall panels to form a coplanar connection to said bottom wall panel modules.

17. The vertical side wall panel module of claim 16, wherein said offset is inclined to the vertical to provide a V-shaped groove between the offset and the adjacent edge of the overlap flange of said bottom wall panel module, said groove being adapted to receive welding material.

18. The vertical side wall panel module of claim 17, wherein said V-shaped groove is adapted to receive welding material flush with the upper surface of said overlap flange of said bottom wall panel module, whereby the entire upper surface of the swimming pool bottom wall will be defined by a common horizontal plane.

19. The vertical side wall panel module of claim 16, wherein the lower portion of said wall is adapted to flex laterally to compensate for lateral stresses and strains.

20. The vertical side wall panel module of claim 16, wherein said horizontally extending portion is adapted to flex vertically to compensate for vertical stresses and strains.

21. The vertical side wall panel module of claim 16, wherein said horizontally extending portion comprises a pool bottom level determining horizontal flange portion, a downwardly inclined offset and a horizontal underlap dimensioned to position the upper surface of a bottom wall panel module overlap flange in the same horizontal plane as the upper surface of said pool bottom level determining horizontal flange portion, whereby said side wall panel module and said bottom wall panel module are positioned in a common horizontal plane.

* * * * *